US009014925B2

(12) United States Patent
Clar et al.

(10) Patent No.: US 9,014,925 B2
(45) Date of Patent: Apr. 21, 2015

(54) SYSTEM AND METHOD FOR DETERMINING A RIPPING PATH

(71) Applicant: Caterpillar Inc., Peoria, IL (US)

(72) Inventors: Jean-Jacques Clar, Edelstein, IL (US); Seth J. Redenbo, Metamora, IL (US); Brian G. Funke, Peorie, IL (US)

(73) Assignee: Caterpillar Inc., Peoria, IL (US)

( * ) Notice: Subject to any disclaimer, the term of this patent is extended or adjusted under 35 U.S.C. 154(b) by 36 days.

(21) Appl. No.: 13/840,581

(22) Filed: Mar. 15, 2013

(65) Prior Publication Data

US 2014/0277957 A1 Sep. 18, 2014

(51) Int. Cl.

| | |
|---|---|
| ***E02F 9/26*** | (2006.01) |
| ***E02F 5/32*** | (2006.01) |
| ***E02F 9/20*** | (2006.01) |

(52) U.S. Cl.

CPC ..... *E02F 5/32* (2013.01); *E02F 9/2045* (2013.01); *E02F 9/205* (2013.01); *E02F 9/262* (2013.01)

(58) Field of Classification Search

CPC ..... A01B 69/00; E02F 9/203
USPC ..... 701/23, 36, 41, 50; 239/69, 74, 172; 172/103, 260.5
See application file for complete search history.

(56) References Cited

U.S. PATENT DOCUMENTS

| | | | | |
|---|---|---|---|---|
| 6,732,458 | B2 * | 5/2004 | Kurenuma et al. | 37/348 |
| 7,873,455 | B2 * | 1/2011 | Arshad et al. | 701/50 |
| 8,332,106 | B2 * | 12/2012 | Yuet et al. | 701/50 |
| 8,360,343 | B2 * | 1/2013 | Gudat et al. | 239/172 |
| 8,594,879 | B2 * | 11/2013 | Roberge et al. | 701/23 |
| 8,639,393 | B2 * | 1/2014 | Taylor et al. | 701/2 |
| 8,639,416 | B2 * | 1/2014 | Jones et al. | 701/41 |
| 8,700,272 | B2 * | 4/2014 | Stratton et al. | 701/50 |
| 2008/0077299 | A1 * | 3/2008 | Arshad et al. | 701/50 |
| 2009/0043462 | A1 * | 2/2009 | Stratton et al. | 701/50 |
| 2010/0299031 | A1 * | 11/2010 | Zhdanov et al. | 701/50 |
| 2010/0312428 | A1 * | 12/2010 | Roberge et al. | 701/23 |
| 2011/0077827 | A1 * | 3/2011 | Arshad et al. | 701/50 |
| 2011/0320085 | A1 * | 12/2011 | Gharsalli et al. | 701/26 |
| 2012/0174445 | A1 * | 7/2012 | Jones et al. | 37/197 |
| 2013/0006484 | A1 * | 1/2013 | Avitzur et al. | 701/50 |
| 2013/0046419 | A1 * | 2/2013 | Anderson et al. | 701/2 |
| 2013/0046439 | A1 * | 2/2013 | Anderson et al. | 701/36 |
| 2013/0046446 | A1 * | 2/2013 | Anderson | 701/50 |
| 2014/0277957 | A1 * | 9/2014 | Clar et al. | 701/50 |

* cited by examiner

*Primary Examiner* — Thomas G Black
*Assistant Examiner* — Wae Louie
(74) *Attorney, Agent, or Firm* — Leydig, Voit & Mayer, Ltd.

(57) ABSTRACT

A system for determining a ripping path includes a position sensing system, a work implement, and a controller. The controller is configured to determine a plurality of positions of the machine as the machine moves along an operating path and the work implement moves a volume of material and sense the material characteristics of at each of the plurality of positions along the operating path. The controller is further configured to determine the ripping path based upon the material characteristics sensed at the plurality of positions and store the ripping path.

20 Claims, 6 Drawing Sheets

SYSTEM AND METHOD FOR DETERMINING A RIPPING PATH

TECHNICAL FIELD

This disclosure relates generally to controlling a machine, and more particularly, to a system and method for determining, in an automated manner, a path or area to be ripped by a ripper mechanism associated with the machine.

BACKGROUND

Machines such as dozers and motor graders are used to perform a variety of tasks including moving, digging, loosening and carrying different materials at a worksite. For example, these machines may include ground engaging implements used to engage a work surface to move material and/or otherwise alter the work surface at a work site. The machines may operate in an autonomous, semi-autonomous, or manual manner to perform these tasks in response to commands that may be generated as part of a work plan for the machines.

When operating a machine to move material according to a material movement plan, under some circumstances, the machine may not be able to efficiently move the desired material according to the plan. The ground or work surface may range from loose soil that may be moved relatively easily to compacted material or material with embedded rocks and other items that are more difficult to move efficiently. As a result, as a machine traverses a work site, it may encounter varying work surface conditions. Upon engaging an area with a relatively hard work surface, the machine may be subjected to excessive wear and move along the work surface without moving a significant amount of material. In such case, it may be desirable to utilize a ripper mechanism to break-up or dislodge the hard material to reduce wear on the machine and so that the machine may move the material in an efficient manner.

Autonomous or semi-autonomous movement of machines is increasingly desirable for many operations including those related to mining, earthmoving and other industrial activities. Autonomously operated machines may remain consistently productive without regard to a human operator or environmental conditions. In addition, autonomous systems may permit operation in environments that are unsuitable or undesirable for a human operator. However, tasks that typically rely upon the judgment of an experienced operator, such as determining when to engage a ripper mechanism, are generally more challenging to perform in an autonomous or semi-autonomous manner.

U.S. Patent Publication No. 2010/0299031 discloses a system for controlling an earthmoving machine in which resistance force vectors of soil resistance to cutting and dragging may be determined and used as input to the control system. The resistance force vector may depend on the volume, weight and condition of the material in front of the blade.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In one aspect, a system for determining a ripping path to be ripped by a ground engaging ripper of a machine includes a position sensing system associated with the machine for determining a position of the machine, a work implement configured to engage an operating path, and a controller. The controller is configured to determine a plurality of positions of the machine as the machine moves along the operating path and the work implement moves a volume of material and sense material characteristics at each of the plurality of positions along the operating path. The controller is further configured to determine the ripping path based upon the material characteristics sensed at the plurality of positions and store the ripping path.

In another aspect, a controller-implemented method of determining a ripping path to be ripped by a ground engaging ripper of a machine includes determining a plurality of positions of the machine based upon a position sensing system associated with the machine as the machine moves along the operating path and a work implement moves a volume of material, and sensing material characteristics at each of the plurality of positions along the operating path. The method further includes determining the ripping path based the material characteristics sensed at the plurality of positions and storing the ripping path.

In still another aspect, a machine includes a prime mover, a position sensing system associated with the machine for determining a position of the machine, a work implement configured to engage an operating path, and a controller. The controller is configured to determine a plurality of positions of the machine as the machine moves along the operating path and the work implement moves a volume of material and sense material characteristics at each of the plurality of positions along the operating path. The controller is further configured to determine the ripping path based upon the material characteristics sensed at the plurality of positions and store the ripping path.

DETAILED DESCRIPTION

Figure 1:
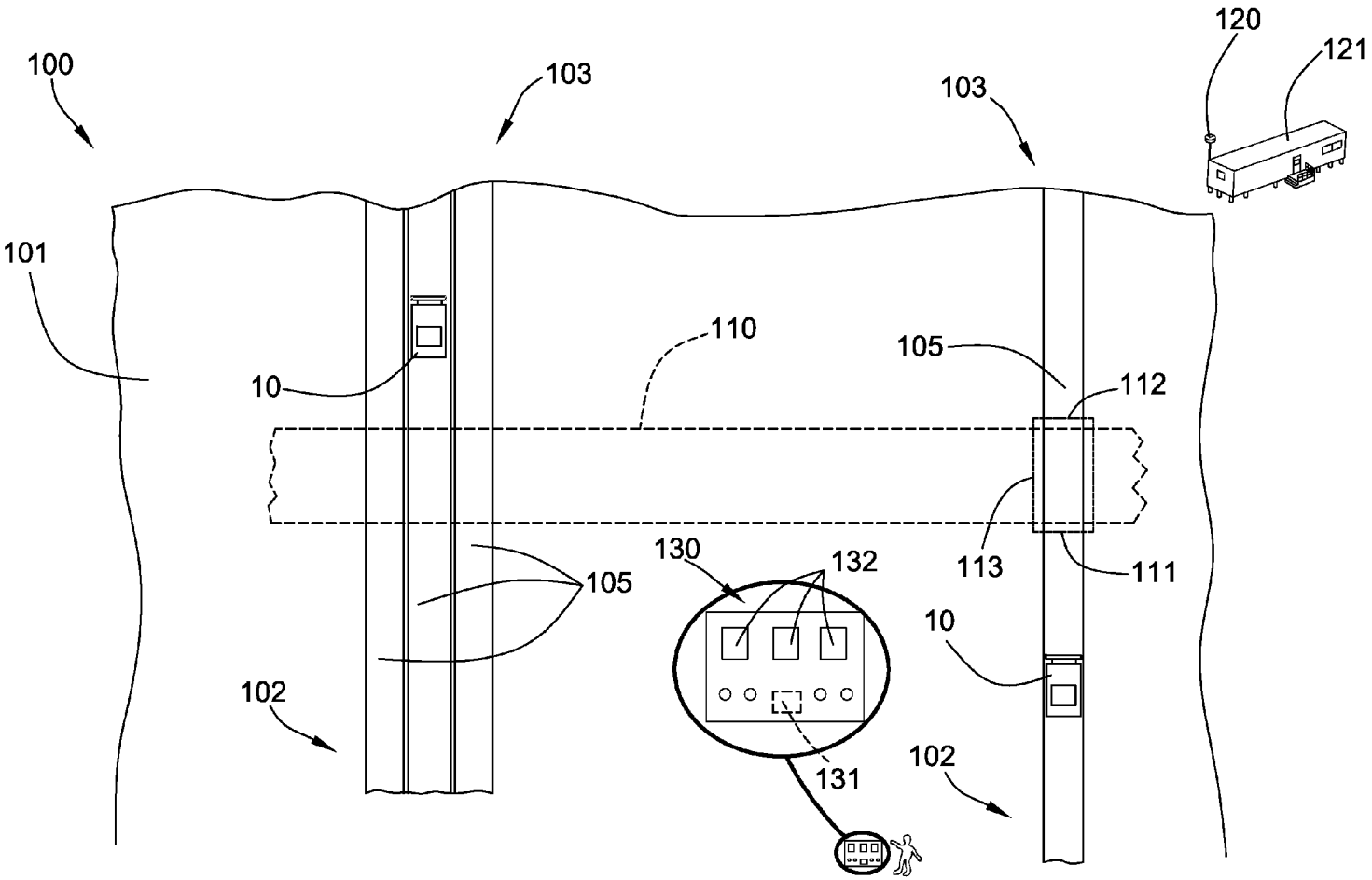
FIG. 1 shows a schematic view of an exemplary work site at which a machine incorporating the principles disclosed herein may be used.

FIG. 1 depicts a diagrammatic illustration of a work site 100 at which one or more machines 10 may operate in an autonomous, a semi-autonomous, or a manual manner. Work site 100 may be a portion of a mining site, a landfill, a quarry, a construction site, a roadwork site, a forest, a farm, or any other area in which movement of material is desired. Tasks associated with moving material may include a dozing operation, a grading operation, a leveling operation, a bulk material removal operation, or any other type of operation that results in the alteration of the current topography at work site 100.

A machine 10 such as dozer may be configured to move material along a work surface 101 at the work site 100 according to one or more material movement plans from an initial location 102 to a spread or dump location 103. The dump location 103 may be at a crest or at any other location. Work surface 101 may take any form and refers to the actual profile or position of the terrain of the work site. In one example, material movement plans may include, among other things, forming a plurality of spaced apart channels or slots 105 that are cut into the work surface 101 at work site 100 along a path from the initial location 102 to the dump location 103. In doing so, machine 10 may move back and forth along a generally linear path between the initial location 102 and the dump location 103. If desired, a relatively small amount of material may be left or built up as walls or windrows between adjacent slots 105 to prevent or reduce spillage and increase the efficiency of the material moving process. The walls between the slots 105 may be moved after the slots are formed or periodically as desired. The process of moving material through slots 105 while utilizing walls of material to increase the efficiency of the process is sometime referred to as "slot dozing."

Figure 2:
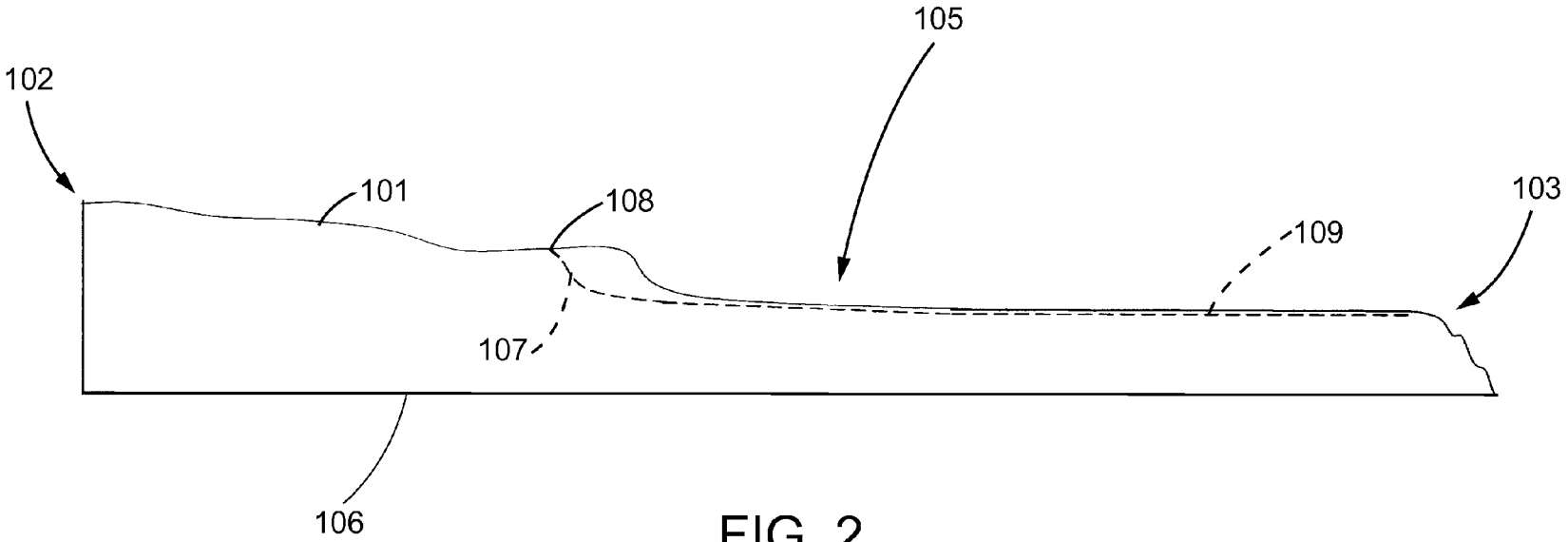
FIG. 2 shows a cross-section of a portion of a work site depicting a material movement plan.

As depicted in FIG. 2, in one embodiment, each slot 105 may be formed by initially setting the desired parameters of the final work surface or final design plane 106. Material may be removed from the work surface 101 in one or more layers or passes until the final design plane 106 is reached. The blade 11 of machine 10 may engage the work surface 101 with a series of cuts, such as the cut depicted at 107, that are spaced apart lengthwise along the slot 105. Each cut 107 begins at a cut location 108 along the work surface 101 at which the blade 11 initially engages the work surface and extends into the material towards the pass target or carry surface as depicted by dashed line 109 for a particular pass. The blade 11 may be guided along each cut 107 until reaching the carry surface 109 and then follow the carry surface towards the dump location 103.

Work surface 101 represents the uppermost height of the existing material at the slot 105. While the illustration is depicted in two dimensions, it should be appreciated that the data representing the illustration may be in three dimensions. For example, the data representing work surface 101 may include a plurality of data points that represent the uppermost height of the existing material at a plurality of locations along work surface 101. This information may be obtained according to any method known in the art. In one example, the machine 10 may utilize the position sensing system 33 described below to map out the contour or topography of work surface 101 as machine 10 moves across it. This data may also be obtained according to other methods such as by a vehicle that includes lasers and/or cameras. It should be noted that as the machine 10 moves material to the dump location 103, the position of the work surface 101 may be updated, such as based upon the current position of the machine 10 and the position of the blade 11.

As used herein, a machine 10 operating in an autonomous manner operates automatically based upon information received from various sensors without the need for human operator input. As an example, a haul or load truck that automatically follows a path from one location to another and dumps a load at an end point may be operating autonomously. A machine 10 operating semi-autonomously includes an operator, either within the machine or remotely, who performs some tasks or provides some input and other tasks are performed automatically and may be based upon information received from various sensors. As an example, a load truck that automatically follows a path from one location to another but relies upon an operator command to dump a load may be operating semi-autonomously. In another example of a semi-autonomous operation, an operator may dump a bucket from an excavator in a load truck and a controller may automatically return the bucket to a position to perform another digging operation. A machine 10 being operated manually is one in which an operator is controlling all or essentially all of the functions of the machine. A machine 10 may be operated remotely by an operator (i.e., remote control) in either a manual or semi-autonomous manner.

Figure 3:
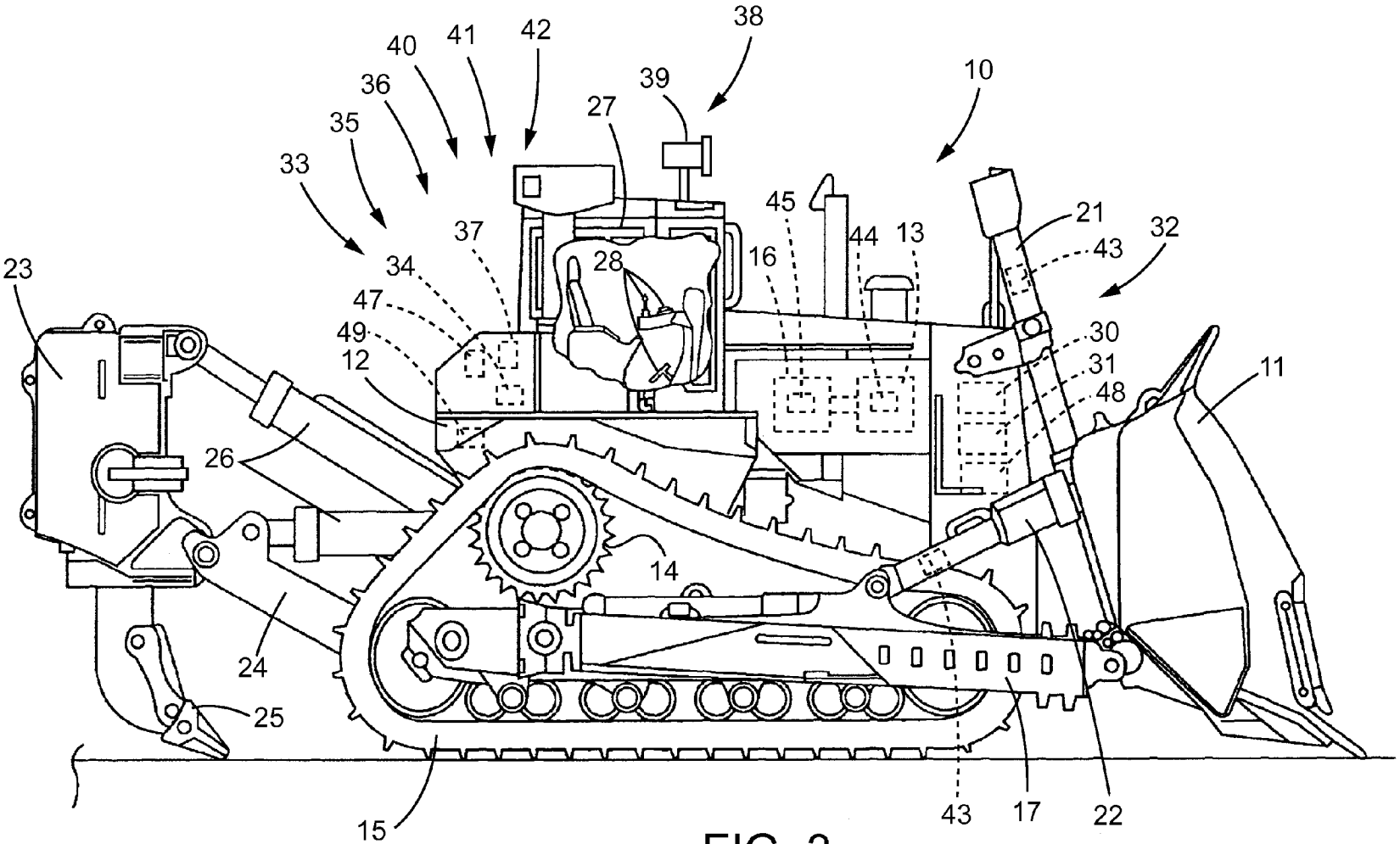
FIG. 3 shows a diagrammatic illustration of a machine in accordance with the disclosure.

FIG. 3 shows a diagrammatic illustration of a machine 10 such as a dozer with a work implement or blade 11 for pushing material. The machine 10 includes a frame 12 and a prime mover such as an engine 13. A ground-engaging drive mechanism such as a track 15 is driven by a drive wheel 14 on each side of machine 10 to propel the machine. Although machine 10 is shown in a "track-type" configuration, other configurations, such as a wheeled configuration, may be used.

The systems and methods of the disclosure may be used with any machine propulsion and drivetrain mechanisms applicable in the art including hydrostatic, electric, or a mechanical drive. Machine 10 may be configured with a type of mechanical drive system so that engine 13 drives a torque converter 16 which in turn drives a transmission (not shown). The transmission may be operatively connected to the drive wheels 14 and the tracks 15. Operation of the engine 13 and transmission, and thus the drive wheels 14 and tracks 15, may be controlled by a control system 35 including a controller 36. Other types of prime movers and drive systems are contemplated.

Machine 10 may include a first ground engaging work implement such as blade 11 pivotally connected to frame 12 by arms 17 on each side of machine 10. First hydraulic cylinder 21 coupled to frame 12 supports blade 11 in the vertical direction, and allows blade 11 to move up and down vertically from the point of view of FIG. 3. Second hydraulic cylinders 22 on each side of machine 10 allow the pitch angle of blade tip to change relative to a centerline of the machine.

Machine 10 may include a second ground engaging work implement such as ripper 23 pivotally connected to frame 12. The ripper 23 may include a ripper linkage 24 with one or more ground engaging ripper shanks 25 for engaging and digging into work surface 101. One or more actuators or hydraulic cylinders 26 may be provided to control the position of the ripper linkage 24.

Machine 10 may include a cab 27 that an operator may physically occupy and provide input to control the machine. Cab 27 may include one or more input devices 28 through which the operator may issue commands to control the propulsion and steering of the machine as well as operate various implements associated with the machine.

Machine 10 may be equipped with a plurality of sensors that provide data indicative (directly or indirectly) of various operating parameters of the machine. The term "sensor" is meant to be used in its broadest sense to include one or more sensors and related components that may be associated with the machine 10 and that may cooperate to sense various functions, operations, and operating characteristics of the machine.

One or more movement sensors may be positioned on the machine 10 for sensing movement of the machine 10 and generating movement signals indicative of movement of the machine. A pitch rate sensor 30 (e.g., a gyroscope) may be provided or mounted on the machine 10, on the blade 11, or on an implement frame member to which the blade is mounted. The pitch rate sensor 30 may be used to provide a pitch rate signal indicative of a measured pitch rate of the machine 10 or the blade 11, depending upon the location of the sensor. The pitch rate sensor 30 may be a "stand-alone" sensor or part of a multi-function sensor such as an inertial measurement unit that also measures the acceleration of the machine 10 along various axes. The pitch rate measured by the pitch rate sensor 30 is indicative of the rate of change of the pitch angle of the sensor.

An acceleration sensor 31 (e.g., a 3-axis accelerometer) may also be provided as a separate component or part of a multi-function sensor. The acceleration sensor 31 may be used to provide an acceleration signal indicative of acceleration of the machine 10 relative to a gravity reference. If the acceleration sensor 31 is not part of a multi-function sensor, it may be positioned adjacent the pitch rate sensor 30 or at another location on machine 10.

One or more implement position sensors indicated generally at 32 may be provided for determining the position of the blade 11 relative to the machine 10. In one embodiment, the implement position sensors 32 may be rotary potentiometers associated with the pivot joints between the machine 10, the arms 17 and the blade 11. In another example, sensors may be associated with the hydraulic cylinders to determine the displacement of each cylinder. The displacement of the cylinders may be used to determine the position of the blade 11. Other types of sensors are also contemplated.

A position sensing system 33, as shown generally by an arrow in FIG. 3 indicating association with the machine 10, may include a position sensor 34 to sense a position of the machine relative to the work site 100. The position sensor 34 may include a plurality of individual sensors that cooperate to provide signals to controller 36 to indicate the position of the machine 10. In one example, the position sensor 34 may include one or more sensors that interact with a positioning system such as a global navigation satellite system or a global positioning system to operate as a position sensor. The controller 36 may determine the position of the machine 10 within work site 100 as well as the orientation of the machine such as its heading, pitch and roll. In other examples, the position sensor 34 may be an odometer or another wheel rotation sensing sensor, a perception based system, or may use other systems such as lasers, sonar, or radar to determine the position of machine 10.

Machine 10 may be controlled by a control system 35 as shown generally by an arrow in FIG. 3 indicating association with the machine 10. The control system 35 may include an electronic control module or controller 36. The controller 36 may receive input command signals from a wireless network system 120 (FIG. 1), remote control input command signals from an operator using a remote control unit or remote control console 130 to operate machine 10 remotely, or operator input command signals from an operator operating the machine 10 from within cab 27. The controller 36 may control the operation of various aspects of the machine 10 including the drivetrain as well as the hydraulic systems and other systems that operate the work implements. The control system 35 may utilize various input devices to control the machine 10 and one or more sensors to provide data and input signals representative of various operating parameters of the machine 10 and the environment of the work site 100.

The controller 36 may be an electronic controller that operates in a logical fashion to perform operations, execute control algorithms, store and retrieve data and other desired operations. The controller 36 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller 36 such as power supply circuitry, signal conditioning circuitry, driver circuitry, and other types of circuitry.

The controller 36 may be a single controller or may include more than one controller disposed to control various functions and/or features of the machine 10. The term "controller" is meant to be used in its broadest sense to include one or more controllers and/or microprocessors that may be associated with the machine 10 and that may cooperate in controlling various functions and operations of the machine. The functionality of the controller 36 may be implemented in hardware and/or software without regard to the functionality. The controller 36 may rely on one or more data maps relating to the operating conditions and the operating environment of the machine 10 and the work site 100 that may be stored in the memory of controller. Each of these data maps may include a collection of data in the form of tables, graphs, and/or equations.

The control system 35 may be located on the machine 10 and may also include components located remotely from the machine such as at a command center 121 (FIG. 1) or at the remote control console 130. The functionality of control system 35 may be distributed so that certain functions are performed at machine 10 and other functions are performed remotely. In such case, the control system 35 may include a communications system such as wireless network system 120 for transmitting signals between the machine 10 and a system located remote from the machine. For example, remote aspects of control system 35 may provide generalized commands or information over wireless network system 120 to the machine 10 that the portions of control system 35 on the machine utilize to generate specific commands to operate the various systems of machine 10. In another embodiment, remote control console 130 positioned remote from the machine 10 may provide some or all of the specific commands that are then transmitted by the wireless network system 120 to systems of the machine.

Machine 10 may be configured to be operated autonomously, semi-autonomously, or manually. In case of semi-autonomous or manual operation, the machine may be operated by remote control and/or by an operator physically located within the cab 27. If the machine 10 is configured to operate via a remote control system, a visual image system 38 such as a camera system may be provided on the machine 10 for generating visual images indicative of a point of view relative to the machine 10. The visual image system 38 may include a plurality of visual image sensors such as cameras 39 for generating visual image signals. The visual image signals may be transmitted wirelessly to a system remote from machine 10. In doing so, the visual image signals may be processed to some extent by controller 36 at machine 10 and subsequently transmitted to a remote system or transmitted to the remote system and processed by the remote system. The plurality of cameras 39 of the visual image system 38 may be positioned to capture different views that an operator would have from within the cab 27 of machine 10. In an alternate embodiment, a plurality of cameras 39 may be positioned to provide a point of view including the machine 10 and/or the blade 11 as well as a portion of the work site 100 at which the machine is operating.

Still further, if the machine is being operated via remote control, a portion of the control system 35 may be located at the remote control unit or remote control console 130. Machine 10 may include a machine controller 37 and remote control console 130 may include a console controller 131. The machine controller 37 and the console controller 131 may be components of controller 36. In one example, the remote control console 130 may be configured with an instrument array similar to that of the machine 10 with a plurality of gauges, displays 132, and input devices such as buttons, knobs, dials, levers, joysticks, and other controls. The remote control console 130 may receive directly or indirectly signals from the various sensors on the machine 10. Machine 10 and remote control console 130 may each include communication devices such as wireless transceivers (not shown) to permit wireless signal transmission between the machine and the remote control console. Still further, the wireless transceivers may permit communication with other systems remote from both the machine 10 and the remote control console 130.

The efficiency by which machine 10 may move material at the work site 100 along a desired path such as slot 105 may be dependent to some extent on the hardness, type, or composition of the material being moved. If the material is relatively hard, the blade 11 of machine 10 may not be able to penetrate the work surface 101 as desired to efficiently move material according to the material movement plan. Rocks and other items or materials that are embedded in the work surface may also impede an efficient material moving process. Further, attempting to move certain types of materials (e.g., that which is especially hard, or embedded with rocks, clay and/or other items) may cause excessive wear or damage to the machine 10. Accordingly, it may be desirable engage certain areas of the work site 100 with ripper 23 secured to machine 10 to break-up, soften, or otherwise condition the work surface so that the machine 10 is more likely to be able to move the material along the path in an efficient manner.

In the example depicted in FIG. 1, a road or path 110 is depicted in dashed lines along which machines such as haul trucks (not shown) may have previously traveled which resulted in the path being particularly compacted and hard. Inasmuch as the slots 105 intersect with path 110, the hardness of the material along the path may create an obstacle or impediment to the slot dozing operation of machine 10. As a result, it may be desirable to perform a ripping operation to rip the hardened work surface along path 110.

The control system 35 may include a system such as a work surface analysis system 40 shown generally by an arrow in FIG. 3 indicating association with the machine 10 to determine in an automated manner the hardness of the work surface 101 or whether objects such as rocks and other objects are embedded in the work surface which will prevent or impede movement of the material along the work surface such as by blade 11. By determining the hardness of the material being moved or whether it contains embedded rocks and other materials, an area or path may be determined for which a ripping operation is desirable. In doing so, the controller 36 may determine a starting point 111 and an end 112 of a ripping path 113 along which the work surface is relatively hard or exceeds a predetermined hardness, or has impeded rocks and other objects.

A ripping operation may be performed by moving the machine 10 to the beginning of the ripping path 113 and lowering or moving the ripper 23 into engagement with the work surface 101. The machine 10 may then be moved forward while the ripper shanks 25 of the ripper 23 engage the work surface 101. In some situations, operating conditions of the machine 10 and/or the ripper 23 may be monitored so that the forces on the ripper do not exceed a predetermined value. If the forces exceed the predetermined value, the ripper 23 may be raised to reduce the engagement between the ripper shanks 25 and the work surface 101 and thus reduce the force on the ripper shanks.

One type of work surface analysis system 40 may be an implement load monitoring system 41 shown generally by an arrow in FIG. 3. The implement load monitoring system 41 may include a variety of different types of implement load sensors depicted generally by an arrow in FIG. 3 as an implement load sensor system 42 to measure the load on the ground engaging work implement or blade 11. As blade 11 of machine 10 moves material along work surface 101, the load on the blade may vary based upon the hardness and/or composition of the material. Accordingly, the implement load sensor system 42 may be utilized to measure or monitor the load on the blade 11 and generate implement load signals indicative of the load on the blade. Increases in load may be registered by the controller 36 as an increase in hardness of the work surface 101 or a significant number of imbedded rocks or other items that increase the force required to move the material of the work surface.

In one embodiment, the implement load sensor system 42 may embody one or more pressure sensors 43 for use with one or more hydraulic cylinders, such as second hydraulic cylinders 22, associated with blade 11. Signals from the pressure sensors 43 indicative of the pressure within the second hydraulic cylinders 22 may be monitored by controller 36. Upon receipt of a signal indicating a substantial increase in pressure within the second hydraulic cylinders 22, the controller 36 may determine that the load on blade 11 has been substantially increased due to the characteristics of the work surface 101. Other manners of determining an increase in cylinder pressure associated with an increase in the load on blade 11 are contemplated, including other manners of measuring the pressure within second hydraulic cylinders 22 and measuring the pressure within other cylinders associated with the blade.

In another embodiment, the implement load sensor system 42 may embody sensors for measuring a difference between output from the engine 13 and the output from the torque converter 16. More specifically, an engine speed sensor 44 may be utilized to generate a signal indicative of the speed or output of the engine 13. A torque converter speed sensor 45 may be utilized to monitor the output speed of the torque converter 16. During an operation such as moving material with blade 11, the engine output speed indicated by engine speed sensor 44 and the torque converter output speed indicated by torque converter speed sensor 45 may be relatively constant. Upon engaging material that requires a significant force to move (such as hard material or embedded rocks), the load on the blade 11 will substantially increase and thus cause a change in the relative speeds between the engine 13 and the torque converter 16. Accordingly, by monitoring the difference between the engine speed and the torque converter speed, an increase in load on the blade 11 may be determined.

Other manners of measuring differences between prime mover output and other components within the propulsion and drivetrain mechanisms that are reflective of a change in load on the blade 11 are also contemplated. Still further, in alternate embodiments in which the machine propulsion and drivetrain mechanisms are hydrostatic or electric, the implement load sensor system 42 may embody other sensors that detect a difference between output from the prime mover and other aspects of the propulsion and drivetrain mechanisms that may be used by the controller 36 to detect an increase in load on the blade 11.

In still another embodiment, implement load sensor system 42 may embody acceleration sensor 31 such as a three-axis accelerometer for providing an acceleration signal indicative of measured acceleration of the machine 10. Upon the blade 11 engaging hard material or material having rocks and other items embedded therein, the machine 10 may decelerate due to the load on the blade 11. Controller 36 may utilize such deceleration of the machine 10 to determine when the machine has reached an area with a hard work surface or other characteristics such that it is desirable to rip the area. The controller 36 may utilize the acceleration signal provided by the acceleration sensor 31 to determine the deceleration of the machine 10 along the ground. Other manners of determining the deceleration of machine 10 are also contemplated. In some circumstances, it may desirable to determine the velocity of the machine 10 and then differentiate the velocity to determine the deceleration of the machine.

The load on the blade 11 may also be affected by the slope of the terrain upon which the machine 10 is moving. Accordingly, if desired, the accuracy of the implement load measurement may be increased by utilizing the implement load sensor system 42 in conjunction with a slope or inclination sensor such as pitch angle sensor 48. For example, if the machine 10 is moving uphill, the load on the blade 11 may be higher due to gravity as compared to a machine operating in the same conditions on flat terrain. Similarly, the load on the blade 11 may be lower for the same conditions when operating the machine in a downhill orientation. By determining the slope of the terrain, the controller 36 may more accurately determine changes in the load on the blade 11.

Through the use of an implement load monitoring system 41, controller 36 may sense an increase in load on blade 11 of machine 10. If the increase in load on blade 11 exceeds a predetermined amount, the controller 36 may determine that the work surface 101 engaged by the blade 11 is sufficiently hard and should be designated as an area to be ripped. The controller 36 may utilize position data from the position sensing system 33 to determine the areas to be ripped and record or store the location and dimensions of the area. If desired, the controller 36 may store a plurality of areas designated for ripping. The controller 36 may also use one or more areas designated for ripping to create one or more ripping paths to be subsequently ripped by machine 10 or by one or more other machines equipped with rippers.

In another embodiment, implement load monitoring system 41 may measure the amount of slip of the track 15 to determine an increase in load on the blade 11. As the load on the blade 11 increases, the tracks 15 are more likely to slip. In one example, the controller 36 may measure a drive signal from a drive speed measurement sensor 49 that is indicative of the speed of the tracks 15. The controller 36 may use the actual or drive speed of the tracks 15 to determine the expected speed of the machine 10 and then compare the expected speed to the actual speed of the machine to determine the amount of track slip.

Figure 4:
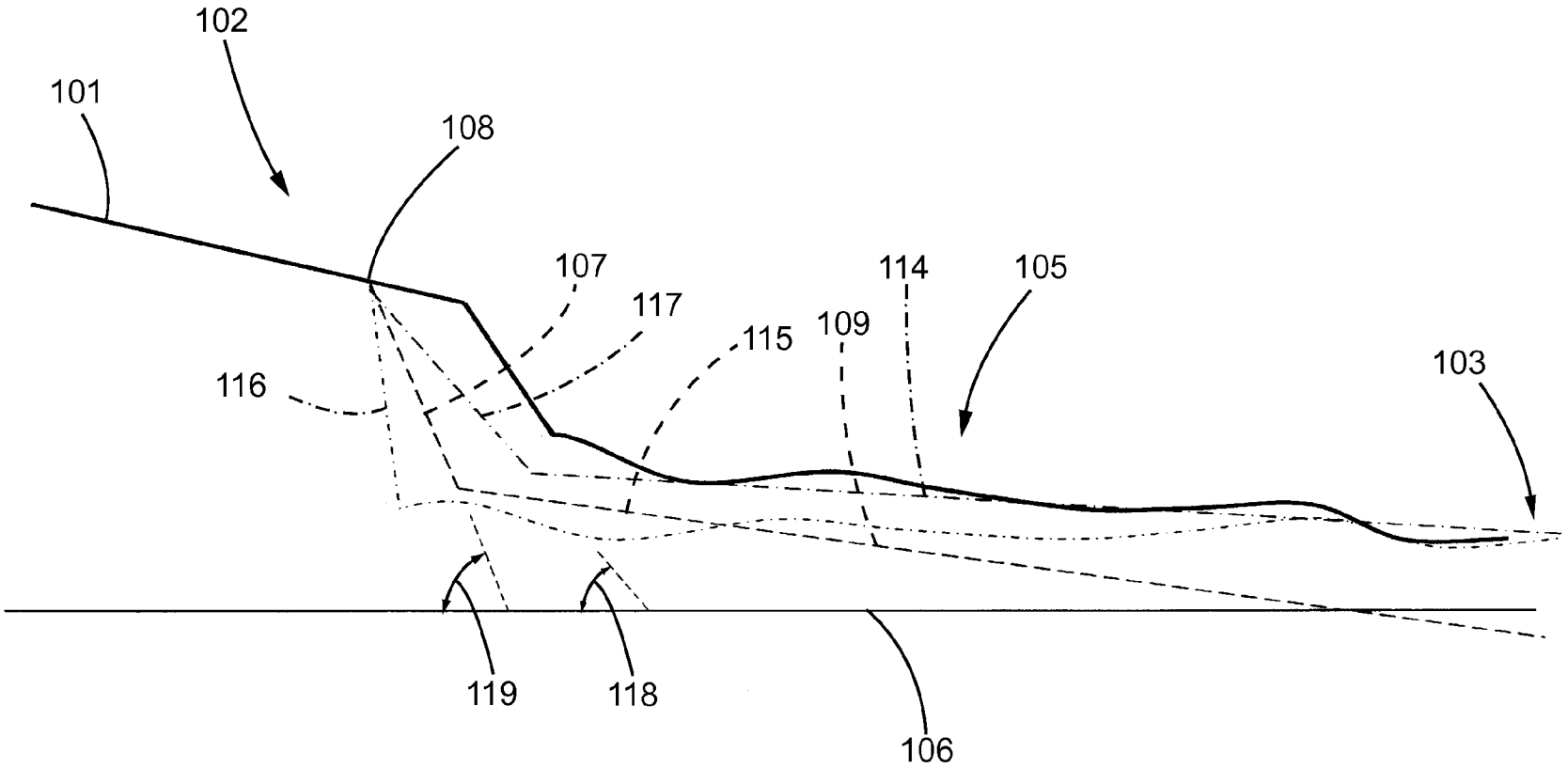
FIG. 4 shows a diagrammatic cross section of a slot depicting alternate paths of a work implement depending upon the characteristics of the material being moved.

In addition to the implement load monitoring systems 41 described above, other work surface analysis systems 40 may be used either alone or in combination with an implement load monitoring system 41. One such addition type of work surface analysis system 40 may use a planning system or module generally indicated at 46 (FIG. 3) of control system 35 together with position sensing system 33 to determine the material characteristics of the work surface 101. Referring to FIG. 4, when slot dozing, one or more characteristics of the slot 105 such as the cut location 108, the loading profile (i.e., the shape and angle of the cut 107), and the carry profile (i.e., the shape and angle of the carry surface 109) may be set by an operator or calculated by the planning system 46. In addition, various types of inputs may be provided to the planning system 46 such as the configuration of the work surface 101, the final design plane 106, and characteristics of the material to be moved. Operating characteristics and capabilities of the machine 10 such as maximum load may also be entered into the planning system 46. The planning system 46 may simulate the results of a material moving pass based upon the desired characteristics set by the operator and the various inputs to the planning system, and then calculate instructions for the machine to carry out the pass that creates the most desirable results based on one or more criteria. The path along which the blade 11 is expected to travel may be referred to as the expected profile as is indicated at 115. It should be noted that the expected profile 115 depicted in FIG. 4 is exemplary and the blade 11 may not follow exactly such profile including the transition between cut 107 and carry surface 109.

One of the inputs to the planning system 46 may be the expected characteristics of the material being moved by machine 10. For example, an operator or some other personnel may input into the planning system 46 a first estimate of the type or characteristics of the material that will be moved or a default value may be set within the controller 36. In some instances, the actual material characteristics may not match the expected material characteristics. If the material characteristics (such as hardness, density, liquid content, or viscosity) are different from those that which were expected, the planning system 46 may define the expected profile 115 in a manner that is difficult for the blade 11 to follow. Control system 35 may utilize a blade control system 47 to control the load on the blade 11 so that the torque generated by the machine 10 is generally maintained at or about a predetermined value. In operation, if the load is too high, the blade control system 47 may raise the blade 11 to reduce the load and similarly lower the blade if the load is lower than an expected value. As a result, when moving material, the blade control system 47 may cause the blade 11 to deviate from the expected profile 115.

More specifically, if the material being moved is softer than that which is expected or estimated, the blade 11 will tend to dig into the material faster than expected and thus the actual profile will not match the expected profile 115. In addition, by digging into the material faster than expected, the blade 11 will likely be loaded faster than expected. Accordingly, the actual profile will not match the expected profile 115 and therefore a blade control system 47 may raise the blade 11 above the carry surface 109 to reduce the load thereon. Accordingly, the blade 11 may only minimally contact the carry surface 109 and thus may not remove undulations from the carry surface. A profile of blade movement with material softer than expected is depicted in FIG. 4 by reference number 116.

If the material of work surface 101 is harder or firmer than expected, the blade 11 may not cut into the work surface 101 in as steep an angle as that of the expected profile 115 and therefore the blade may be under-loaded once it reaches the carry surface 109. Under-loading the blade 11 may reduce the operating efficiency of the machine 10. A profile of blade movement with material firmer than expected is depicted in FIG. 4 by reference number 117. As an example, the cut angle 118 of the profile 117 relative to the final design plane 106 is shallower than the cut angle 119 of the expected profile 115.

In operation, as the machine 10 is moved along the path from the initial location 102 to the dump location 103, the controller 36 may receive data from the position sensor 34. Inasmuch as the position sensor 34 may not be positioned immediately adjacent the work surface 101, the controller 36 may utilize the known dimensions of the machine 10 together with the data from the position sensor 34 to determine the position or configuration of the actual profile or work surface 101. Other manners of determining the configuration of the actual profile are contemplated.

The controller 36 may compare the expected profile 115 to the actual profile or work surface 101 measured during or after the machine 10 has moved from the initial location 102 to the dump location 103. In one example, the controller 36 may compare the cut angle 119 of the actual profile to the cut angle 118 of the expected profile and use the difference to determine a second estimate of the material characteristics of the work surface 101. If the cut angle 119 of the actual profile is less steep than that of the expected profile 115, the controller 36 may determine that the material being moved is a harder material than expected. If the material is sufficiently hard, the controller 36 may designate the area along the cut 107 for a subsequent ripping operation. In one example, the controller 36 may determine that a ripping operation should occur if the actual cut angle 118 is less than the expected cut angle 119 and the difference between such angles exceeds or is greater than a predetermined amount.

In another example, the controller 36 may compare the actual carry profile 114 to the expected carry profile 109. Depending on differences between the slope and any undulations of the actual carry profile 114 as compared to the expected carry profile 109, the controller 36 may determine that the material being moved is harder than expected and may designate all or portions of the carry profile for a subsequent ripping operation. In still another example, the controller 36 may determine that a ripping operation should occur based upon the second estimate of the material characteristics of the work surface.

The control system 35 may incorporate any or all of the work surface analysis systems 40 disclosed herein and may incorporate other systems that perform similar functions, if desired. The controller 36 may store data indicative of the material characteristics from each work surface analysis system 40 generated after the machine 10 has moved along one or more operating paths. The controller 36 may utilize the data to generate one or more maps of the material characteristics of the work surface at a plurality of positions along the operating path. The controller 36 may then determine one or more desired ripping paths 113 based upon the material characteristics sensed at the plurality of positions.

Figure 5:
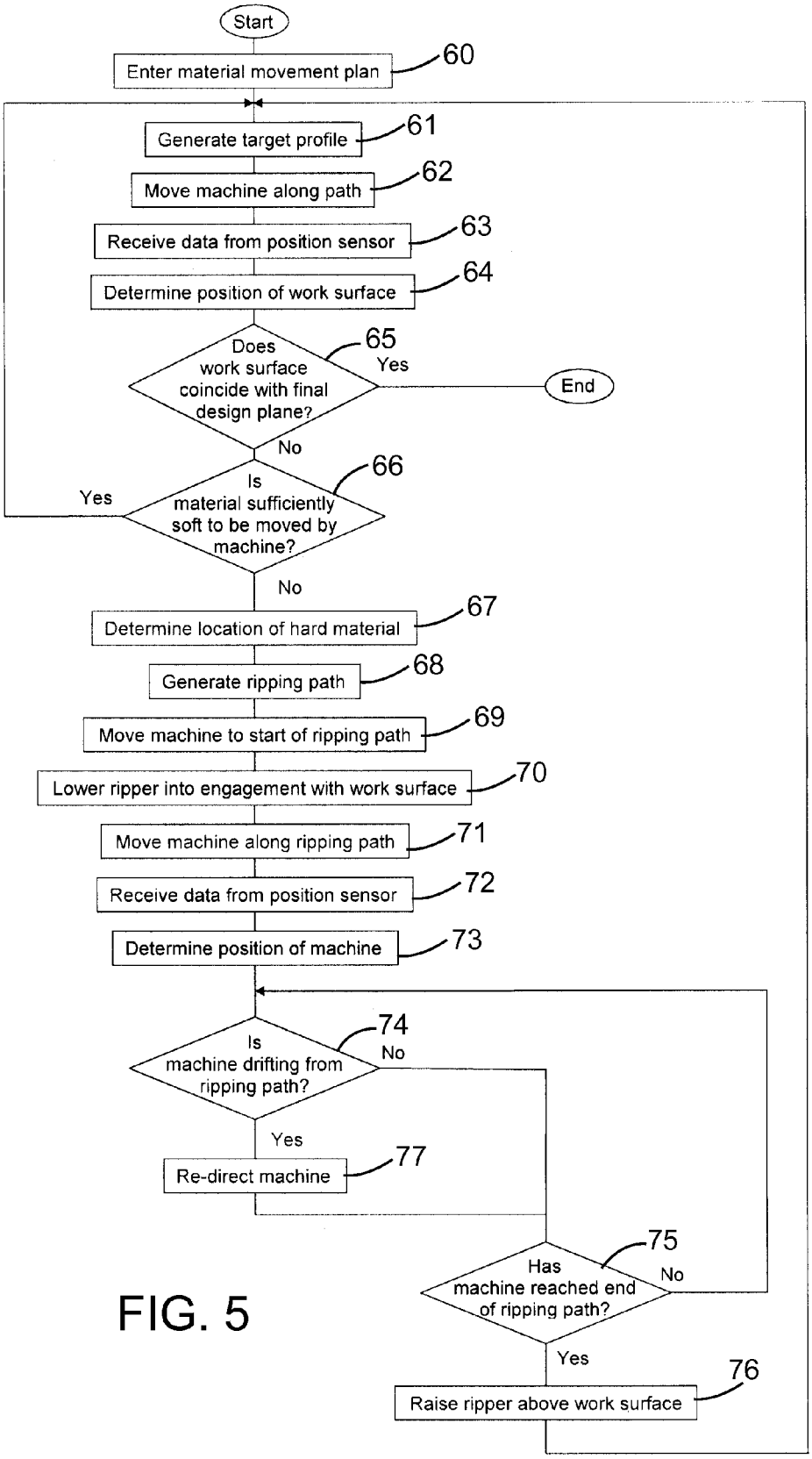
FIG. 5 shows a flowchart of a process for determining an area of a work site to be subject to a ripping operation.

Referring to FIG. 5, a process is depicted for automatically determining an area or path for which ripping may be desirable and subsequently performing the ripping operation. At stage 60, a material movement plan may be entered into controller 36. The material movement plan may include the desired configuration or final design plane 106 of the work site 100. In addition, the material movement plan may specify one or more characteristics of the manner in which the material is moved. In the case of slot dozing, the material movement plan may specify the loading profile, the carry profile and other characteristics of the slot 105. If desired, an estimate of the material characteristics may also be entered into controller 36.

A planning system 46 may generate at stage 61 a target for the expected profile 115 that defines the path that the blade 11 is expected to follow during the material movement process. At stage 62, the controller 36 may move the machine 10 along an operating path while moving the blade 11 as desired to carry out the material moving process. In doing so, the machine 10 may be moved from the initial location 102 to the dump location 103.

As the machine 10 moves along the operating path, the controller 36 may receive at stage 63 data from the position sensor 34. Inasmuch as the position sensor 34 may not be positioned immediately adjacent the work surface 101, the controller 36 may utilize the known dimensions of the machine 10 together with the data from the position sensors 34 to determine at stage 64 the configuration of the actual profile or work surface 101.

At decision stage 65, the controller 36 may compare the actual profile or work surface 101 to the final design plane 106. If the work surface 101 coincides with or matches the final design plane 106, the material moving process may be complete and the machine 10 may stop or perform other operations. If the work surface 101 does not coincide with the final design plane 106, the controller 36 may determine at stage 66 whether the material being moved is sufficiently soft so as to be efficiently moved by the machine 10. If the material being moved by the machine 10 is sufficiently soft to be efficiently moved by the machine, the material movement process may be continued by repeating steps 61-65 until the work surface 101 coincides with the final design plane 106.

When determining whether the material is sufficiently soft to be moved by the machine, the controller 36 may use one or more work surface analysis systems 40 as described above. More specifically, the load on the blade 11 may be monitored using an implement load monitoring system 41 to measure the pressure within one or more hydraulic cylinders associated with the blade 11 or may monitor the load on the engine 13 and associated components of the drivetrain. An increase in pressure at the hydraulic cylinder or an increase in required torque within the drivetrain may be interpreted as an increase in the hardness of the material. While doing so, the controller 36 may determine that the material is harder than that which may be efficiently moved by the machine 10.

In another embodiment, the implement load monitoring system 41 may use an implement load sensor system 42 that embodies an acceleration sensor 31 and a rapid deceleration of the machine 10 may be interpreted by controller 36 as an indication that the blade 11 has engaged material that is harder than desired for efficient movement by the machine. While the controller 36 is monitoring the pressure within the hydraulic cylinders, the torque differential within the drivetrain and/or the deceleration of the machine 10, the controller 36 may record and store data associated with the implement load monitoring system 41. The controller 36 may compare the data to data maps of the controller to determine the hardness of the material of work surface 101. In addition, the controller 36 may associate the position of the machine 10 as determined from the data generated by position sensing system 33 with the data generated by the implement load monitoring system 41 so that a map of the path along which the machine is moving may be generated that includes an indication of the hardness of the work surface 101.

In an alternate embodiment, the controller 36 may determine the hardness of the work surface 101 by generating an expected profile 115 and comparing the expected profile to the actual profile or work surface 101 after each material movement pass. Differences between the expected profile 115 and the work surface 101 may be used by the controller 36 as an alternate or additional source for determining the hardness of the work surface 101. The controller 36 may store the hardness data along the path to generate a map of the operating path of the machine 10 that includes an indication of the hardness of the work surface 101 along the path.

If the material is harder than that which may be efficiently moved by the machine 10, the controller 36 may generate at stage 67 a map of the operating path that reflects the hardness of the material along the path. The controller 36 may generate at stage 68 a ripping path 113 along which it is desirable to move the machine 10 with the ripper 23 engaging the work surface 101.

To perform such a ripping operation, the machine 10 may be moved at stage 69 to the starting point 111 of the ripping path 113 with the ripper in a raised position above the work surface 101. At stage 70, the controller 36 may generate a ripper engagement command to move the ripper 23 into engagement with the work surface 101. At stage 71, the controller may generate a ripping operation command to move the machine 10 along the ripping path 113 with the ripper 23 in engagement with the work surface 101.

While moving the machine 10 along the ripping path 113, the controller 36 may continue to receive data at stage 72 from the position sensor 34 indicative of the position of the machine. At stage 73, the controller 36 may determine the position of the machine 10 based upon the data received from the position sensor 34. At decision stage 74, the controller 36 may compare the actual position of the machine 10 to the ripping path 113 to determine whether the machine has drifted from the ripping path. If the machine 10 has not drifted from the ripping path, the controller 36 may determine at decision stage 75 whether the machine 10 has reached the end 112 of the ripping path 113. If the machine 10 has not reached the end 112 of the ripping path 113, the machine may continue to move along the ripping path and the controller 36 may monitor the machine at stage 74 for drift from the ripping path.

If the machine 10 has reached the end 112 of the ripping path 113, the controller 36 may raise the ripper 23 above the work surface 101 at stage 76 and return the machine to a desired position at which a new target profile may be generated at stage 61 and the machine moved along the operating path to continue according to the material movement plan.

Figure 6:
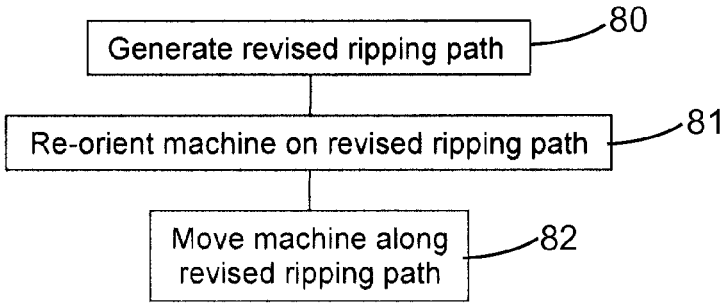
FIG. 6 shows a flowchart of a process for re-directing the orientation of the machine during a ripping operation.

If the machine 10 is drifting from the ripping path at decision stage 74, the controller 36 may re-direct the machine 10 at stage 77. In some instances, as depicted in FIG. 6, the controller 36 may generate a revised ripping path at stage 80 based upon the original ripping path 113 and the current location and heading of machine 10. At stage 81, either while the machine 10 is moving or while the machine 10 has momentarily stopped, the controller 36 may re-orient the machine along the revised ripping path. The machine 10 may then continue to be moved along the revised ripping path at stage 82.

Figure 7:
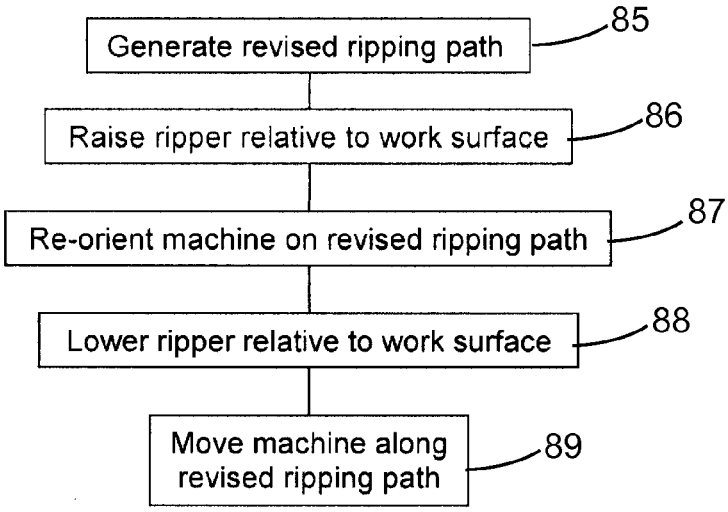
FIG. 7 shows a flowchart of an alternate process for re-directing the orientation of the machine during a ripping operation.

In an alternate process depicted in FIG. 7 for re-directing machine 10 at stage 77, the controller 36 may generate at stage 85 a revised ripping path based upon the original ripping path 113 and the current location and heading of machine 10. The ripper 23 may be raised at stage 86 relative to the work surface 101. In some instances, the ripper 23 may be raised above the work surface 101. In other instances, the ripper 23 may be raised relative to the work surface 101 to reduce the extent of the engagement of the ripper shanks 25 with the work surface 101 so as to reduce the force on the ripper shanks. At stage 87, with the ripper shanks 25 either positioned above the work surface 101 or with a reduced engagement between the ripper shanks and the work surface, the machine 10 may be re-orientated so that the machine is positioned along the revised ripping path. Once the machine 10 is re-oriented, the ripper 23 may be lowered at stage 88 relative to the work surface 101 so that the ripper shanks 25 engage the work surface with the desired force. At stage 89, the machine 10 may be moved along the revised ripping path with the ripper shanks 25 engaging the work surface 101.

Figure 8:
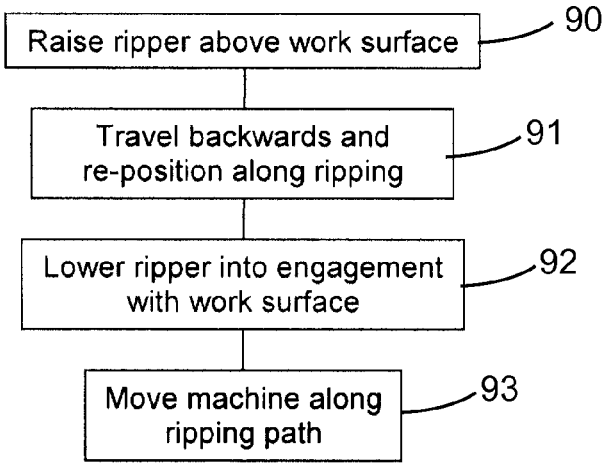
FIG. 8 shows a flowchart of still another alternate process for re-directing the orientation of the machine during a ripping operation.

Still another alternate process for re-directing the machine 10 if it drifts from the ripping path is depicted in FIG. 8. At stage 90, the ripper 23 may be raised so that ripper shanks 25 are above the work surface 101. The machine 10 may be moved backwards at stage 91 and repositioned along the ripping path 113 generated at stage 68. Movement of the machine 10 may be backwards and somewhat at an angle to the ripping path 113 so as to re-position the machine along the ripping path in an efficient manner. The ripper 23 may be lowered at stage 92 so that ripper shanks 25 engage the work surface 101. The machine 10 may be moved at stage 93 along the ripping path to continue the ripping operation.

In each instance in which the machine 10 may be re-directed according to FIGS. 6-8, once the machine 10 is moving forwards along either the ripping path 113 or a revised ripping path, the machine 10 will continue to move forward and the process will be continued at decision stage 75.

INDUSTRIAL APPLICABILITY

The industrial applicability of the system described herein will be readily appreciated from the forgoing discussion. The foregoing discussion is applicable to machines 10 that are autonomously or semi-autonomously operated to move material according to a material movement plan. Such system may be used at a mining site, a landfill, a quarry, a construction site, a roadwork site, or any other area in which movement of material desired.

Determining in an automated manner which areas of a work site 100 should be subject to a ripping operation may be particularly challenging. In accordance with the disclosure, as machine 10 moves, the controller 36 may receive signals or data from various systems and sensors associated with the machine. The controller 36 may use the signals and data to determine in an automated manner that the work surface 101 is too hard to be moved efficiently by machine 10. The controller 36 may make such a determination based upon any or all of an increase in load on the blade 11, slip of the tracks 15, or by comparing the actual profile or work surface 101 to the expected profile 115.

The controller 36 may generate a map of areas of the work site 100 having a work surface 101 that is particularly hard. The controller 36 may then generate a ripping path 113 based upon the map and direct the machine to perform a ripping operation along the path.

It will be appreciated that the foregoing description provides examples of the disclosed system and technique. All references to the disclosure or examples thereof are intended to reference the particular example being discussed at that point and are not intended to imply any limitation as to the scope of the disclosure more generally. For example, although described in the context of slot dozing, the foregoing description is applicable to a wide variety of environments, operations, and applications. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A system for determining a ripping path to be ripped by a ground engaging ripper of a machine, comprising:

a position sensing system associated with the machine for determining a position of the machine;

a blade configured to engage and move a volume of material along an operating path; and a controller configured to:

determine a plurality of positions of the machine based upon the position sensing system as the machine moves along the operating path and the blade moves the volume of material along the operating path;

determine material characteristics at each of the plurality of positions along the operating path based upon engagement of the volume of material by the blade;

determine the ripping path based upon the material characteristics determined at the plurality of positions; and store the ripping path.

2. The system of claim 1, wherein the controller is further configured to generate a map of the material characteristics along the operating path and determine the ripping path based upon the map of the material characteristics.

3. The system of claim 1, further including an implement load sensor system configured to measure a load on the blade and provide an implement load signal indicative of the load on the blade to the controller, the controller being further configured to receive the implement load signal, determine the load on the blade, and determine the material characteristics based upon the load on the blade.

4. The system of claim 3, wherein the implement load sensor system includes a sensor for monitoring a difference between output from a prime mover and output from a torque converter, and the controller is configured to determine an increase in the load on the blade based upon an increase in a difference between the output from the prime mover and the output from the torque converter.

5. The system of claim 3, wherein the implement load sensor system includes a pressure sensor for monitoring pressure within a hydraulic cylinder operatively connected to the blade, and the controller is configured to determine an increase in load on the blade based upon an increase in pressure within the hydraulic cylinder.

6. The system of claim 3, wherein the implement load sensor system includes an acceleration sensor for monitoring deceleration of the machine, and the controller is configured to determine an increase in load on the blade based upon a deceleration of the machine.

7. The system of claim 6, further including a pitch angle sensor, and the controller is configured to determine the deceleration of the machine at least in part based upon a signal from the pitch angle sensor.

8. The system of claim 1, wherein the controller is further configured to:

determine an expected profile extending through a work surface along the operating path before the blade moves the volume of material;

determine an actual profile of the operating path after the blade moves the volume of material based upon the plurality of positions;

compare the expected profile to the actual profile; and determine the material characteristics based upon a difference between the expected profile and the actual profile.

9. The system of claim 8, wherein the controller is further configured to:

store a first estimate of the material characteristics of the operating path, utilize a planning system to determine the expected profile, the expected profile being based upon the first estimate of the material characteristics;

determine a second estimate of the material characteristics based upon the difference between the expected profile and the actual profile; and determine the material characteristics based upon the second estimate of the material characteristics.

10. The system of claim 1, wherein the controller is further configured to move the machine to align a ground engaging ripper with a starting point of the ripping path, generate a ripper engagement command to move the ground engaging ripper into engagement with the ripping path, and generate a ripping operation command to move the machine along the ripping path.

11. A controller-implemented method of determining a ripping path to be ripped by a ground engaging ripper of a machine, comprising:

determining a plurality of positions of the machine based upon a position sensing system associated with the machine as the machine moves along the operating path and a blade engages and moves a volume of material along the operating path;

determining material characteristics at each of the plurality of positions along the operating path based upon engagement of the volume of material by the blade;

determining the ripping path based upon the material characteristics determined at the plurality of positions; and storing the ripping path.

12. The method of claim 11, further including generating a map of the material characteristics along the operating path and determining the ripping path based upon the map of the material characteristics.

13. The method of claim 11, further including receiving a implement load signal indicative of a load on the blade from an implement load sensor system configured to measure a load on the blade, determining the load on the blade, and determining the material characteristics based upon the load on the blade.

14. The method of claim 13, further including determining an increase in the load on the blade based upon an increase in difference between output from a prime mover and output from a torque converter.

15. The method of claim 13, further including monitoring pressure within a hydraulic cylinder operatively connected to the blade, and determining an increase in load on the blade based upon an increase in pressure within the hydraulic cylinder.

16. The method of claim 13, further including monitoring deceleration of the machine, and determining an increase in load on the blade based upon a deceleration of the machine.

17. The method of claim 16, further including determining the deceleration of the machine at least in part based upon a signal from a pitch angle sensor.

18. The method of claim 11, further including:

determining an expected profile extending through a work surface along the operating path before the blade moves the volume of material;

determining an actual profile of the operating path after the blade moves the volume of material based upon the plurality of positions;

comparing the expected profile to the actual profile; and determining the material characteristics based upon a difference between the expected profile and the actual profile.

19. The method of claim 18, further including:

storing a first estimate of the material characteristics of the operating path, utilizing a planning system to determine the expected profile, the expected profile being based upon the first estimate of the material characteristics;

determining a second estimate of the material characteristics based upon a difference between the expected profile and the actual profile; and determining the material characteristics based upon the second estimate of the material characteristics.

20. A machine comprising:

a prime mover;

a position sensing system associated with the machine for determining a position of the machine;

a blade configured to engage and move a volume of material along an operating path; and a controller configured to:

determine a plurality of positions of the machine based upon the position sensing system as the machine moves along the operating path and the blade moves the volume of material along the operating path;

determine material characteristics at each of the plurality of positions along the operating path based upon engagement of the volume of material by the blade;

determine the ripping path based upon the material characteristics determined at the plurality of positions; and store the ripping path.

* * * * *

UNITED STATES PATENT AND TRADEMARK OFFICE

CERTIFICATE OF CORRECTION

PATENT NO. : 9,014,925 B2
APPLICATION NO. : 13/840581
DATED : April 21, 2015
INVENTOR(S) : Clar et al.

It is certified that error appears in the above-identified patent and that said Letters Patent is hereby corrected as shown below:

Title Page, Column 1, Item 72 (Inventors), line 3, delete "Peorie," and insert -- Peoria, --.

Signed and Sealed this
Twenty-sixth Day of July, 2016

Michelle K. Lee

Michelle K. Lee
*Director of the United States Patent and Trademark Office*